US012480744B2

(12) United States Patent
Lee et al.

(10) Patent No.: US 12,480,744 B2
(45) Date of Patent: Nov. 25, 2025

(54) FIREARM ROTATION MOUNT FOR OPTICS AND ACCESSORIES

(71) Applicant: Strike IP, LLC, Las Vegas, NV (US)

(72) Inventors: Shanyao Lee, Las Vegas, NV (US); Chien-Yuan Cheng, Las Vegas, NV (US)

(73) Assignee: Strike IP, LLC, Las Vegas, NV (US)

( * ) Notice: Subject to any disclaimer, the term of this patent is extended or adjusted under 35 U.S.C. 154(b) by 84 days.

(21) Appl. No.: 18/625,866

(22) Filed: Apr. 3, 2024

(65) Prior Publication Data

US 2024/0337466 A1 Oct. 10, 2024

Related U.S. Application Data

(60) Provisional application No. 63/457,343, filed on Apr. 5, 2023.

(51) Int. Cl.
*F41G 11/00* (2006.01)
*F41A 21/32* (2006.01)

(52) U.S. Cl.
CPC ..... *F41G 11/001* (2013.01); *F41A 21/325* (2013.01)

(58) Field of Classification Search
CPC .... F41A 21/325; F41G 11/001; F41G 11/003; F41G 11/005; F41G 11/006; F41G 11/007; F41G 11/008
USPC ..... 42/90
See application file for complete search history.

(56) References Cited

U.S. PATENT DOCUMENTS 2,527,289 A * 10/1950 Allen ..... F41G 11/008 42/128
2,585,985 A * 2/1952 Anderson ..... F41G 11/007 248/201
2,629,175 A * 2/1953 Merritt ..... F41G 11/008 42/128
3,880,389 A * 4/1975 Burris ..... F41G 11/006 D22/109
4,353,180 A * 10/1982 Wilson ..... F41G 11/006 42/127
4,562,658 A * 1/1986 Govett ..... F41G 11/001 42/125
4,959,908 A * 10/1990 Weyrauch ..... F41G 11/003 42/127

(Continued)

*Primary Examiner* — Troy Chambers
*Assistant Examiner* — Benjamin S Gomberg
(74) *Attorney, Agent, or Firm* — Andy M. Han; Han IP PLLC

(57) ABSTRACT

A device implementable on a firearm includes a rotation mount comprising a first main piece and a second main piece. The first main piece has a first mounting side configured to accommodate mounting of optics and accessories thereon. The second main piece has a second mounting side configured to accommodate a mounting surface on the firearm such that the rotation mount is installable on the firearm via the second main piece. The first main piece is configured with a first coupling portion with a generally cone-shaped first feature. The second main piece is configured with a second coupling portion with a generally cone-shaped second feature configured to mate with the first feature of the first coupling portion such that the first main piece is pivotable around a rotation axis of the rotation mount when the first main piece and the second main piece are pivotably joined together.

8 Claims, 9 Drawing Sheets

(56) References Cited

U.S. PATENT DOCUMENTS

| | | | | |
|---|---|---|---|---|
| 5,390,419 | A * | 2/1995 | Sirkis | F41G 11/006 42/127 |
| 7,121,037 | B2 * | 10/2006 | Penney | F41G 11/001 42/126 |
| 7,313,885 | B1 * | 1/2008 | Looney | F41G 11/001 33/645 |
| 8,893,424 | B2 * | 11/2014 | Haering | F41G 1/387 42/126 |
| 10,240,901 | B1 * | 3/2019 | Cheng | F41A 35/00 |
| 2017/0261288 | A1 * | 9/2017 | Bartoszewicz | F41G 11/003 |

* cited by examiner

FIREARM ROTATION MOUNT FOR OPTICS AND ACCESSORIES

CROSS REFERENCE TO RELATED PATENT APPLICATION

The present disclosure claims the priority benefit of U.S. Provisional Patent Application No. 63/457,343, filed 5 Apr. 2023, the content of which herein being incorporated by reference in its entirety.

TECHNICAL FIELD

The present disclosure is generally related to firearm accessories and, more particularly, to a firearm rotation mount for optics and accessories.

BACKGROUND

Unless otherwise indicated herein, approaches described in this section are not prior art to the claims listed below and are not admitted as prior art by inclusion in this section.

There are many accessories and optics (herein interchangeably referred to as "firearm accessories") on the market that can be mounted on firearms. Some firearm accessories, such as optics mounts, aiming sights grips and related items for example, require rotational capabilities for ergonomic or functional purposes. However, most of current designs of accessory mounts tend to rely on complicated locking mechanisms and/or spring tension, thereby limiting the extent of rotation to specific angle(s), such as 90 to 45 degrees. While accessory mounts under current designs can be quickly operated and turned/rotated to preset or predefined degrees, nevertheless they tend to be not stable and also, they could wobble easily due to machining tolerances. Consequently, this may pose a liability risk, as firearm accessories must be stable and secure when mounted on firearms. Therefore, there is a need for a solution of firearm rotation mount for optics and accessories.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

In view of the aforementioned issue, an objective of the present disclosure is to provide innovative designs of firearm rotation mount for optics and accessories. It is believed that firearm rotation mount for optics and accessories under various proposed schemes in accordance with the present disclosure may address aforementioned issues associated with current designs. For instance, under the proposed schemes, two main pieces-one mail and one female—each with cone-shaped tapers and a center hole may be utilized in a rotation mount for firearm accessories. A joint axis, typically a fastener (or rod) may pass through the center hole of the two main pieces. Once the fastener (or rod) is tightened, the two cone-shaped main pieces mate with or otherwise accommodate each other securely, thereby providing a stable and secure platform for the mounting of firearm accessories.

In one aspect, a device implementable on a firearm may include a rotation mount comprising a first main piece and a second main piece. The first main piece may have a first mounting side configured to accommodate mounting of optics and accessories thereon. The second main piece may have a second mounting side configured to accommodate a mounting surface on the firearm such that the rotation mount is installable on the firearm via the second main piece. The first main piece may be configured with a first coupling portion with a generally cone-shaped first feature. The second main piece may be configured with a second coupling portion with a generally cone-shaped second feature configured to mate with the first feature of the first coupling portion such that the first main piece is pivotable around a rotation axis of the rotation mount when the first main piece and the second main piece are pivotably joined together.

In another aspect, a device implementable on a firearm may include a rotation mount comprising a first main piece and a second main piece. The first main piece may be configured with a first coupling portion with a first feature. The second main piece may be configured with a second coupling portion with a second feature configured to mate with the first feature of the first coupling portion such that the first main piece is pivotable around a rotation axis of the rotation mount when the first main piece and the second main piece are pivotably joined together. One of the first coupling portion and the second coupling portion may include a male plug while the other of the first coupling portion and the second coupling portion may include a female receptable. Additionally, one of the first feature or the second feature may include a generally cone-shaped protrusion of the male plug while the other of the first feature or the second feature may include a generally cone-shaped hollow of the female receptable. Moreover, an outer diameter of the protrusion of the male plug may decrease from a first point near a first mating surface on the first main piece that contacts a second mating surface on the second main piece when the first main piece and the second main piece are joined together to a second point further away from the first mating surface. Correspondingly, a diameter of the hollow of the female receptable may decrease from a third point the second mating surface to a fourth point further away from the second mating surface.

BRIEF DESCRIPTION OF THE DRAWINGS

The accompanying drawings are included to provide a further understanding of the disclosure and are incorporated in and constitute a part of the present disclosure. The drawings illustrate implementations of the disclosure and, together with the description, explain the principles of the disclosure. It is appreciable that the drawings are not necessarily in scale as some components may be shown to be out of proportion than the size in actual implementation to clearly illustrate the concept of the present disclosure.

DETAILED DESCRIPTION OF PREFERRED IMPLEMENTATIONS

Figure 1:
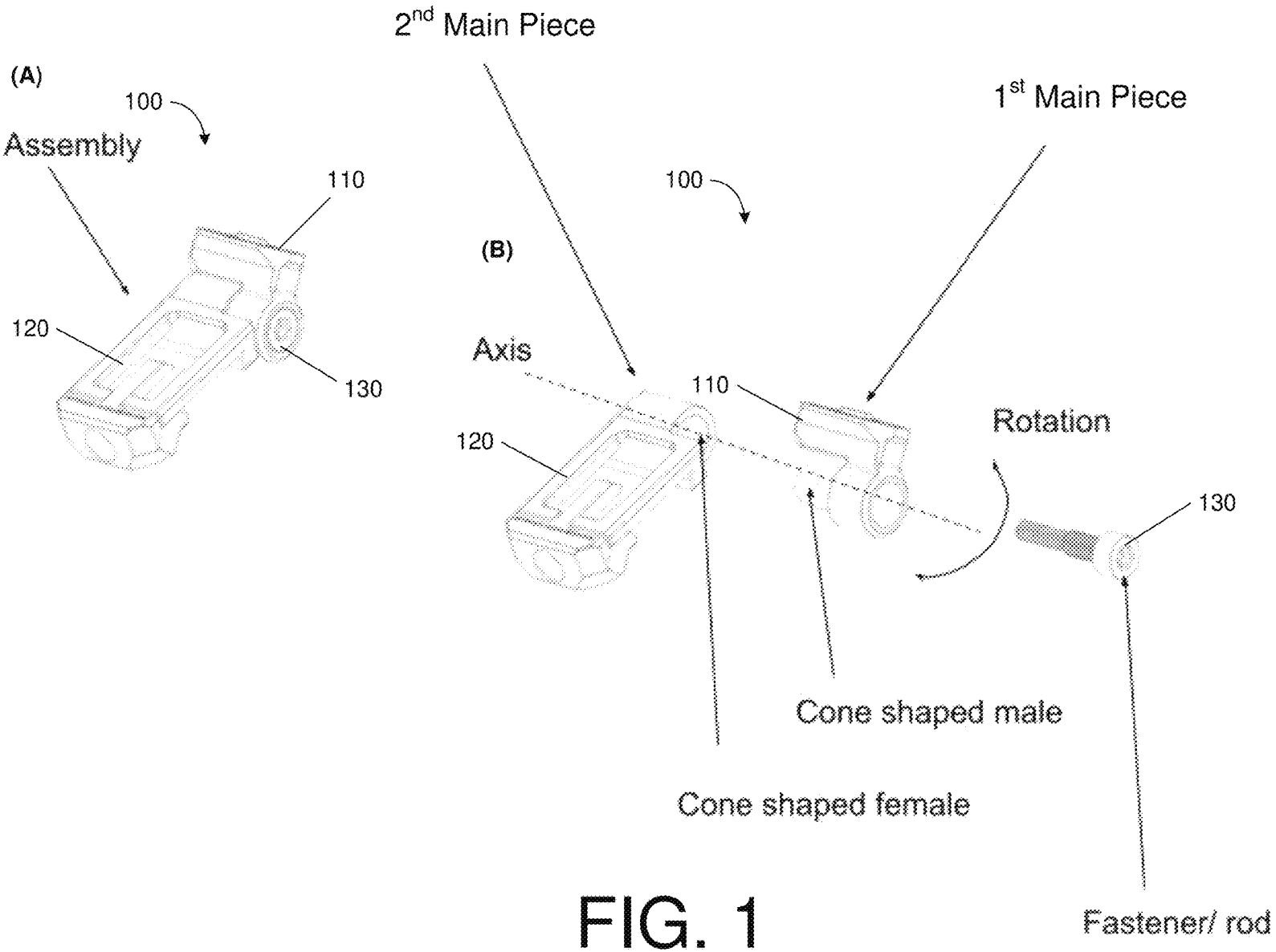
FIG. 1 is a diagram of an example implementation under a proposed scheme in accordance with the present disclosure.

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator or user of the firearm. The same convention applies for the direction statements used herein.

As used herein, the terms "proximal" and "proximally" may denote "forward" and "forwardly" with respect to the firearm, and the terms "distal" and "distally" may denote "rearward" and "rearwardly" with respect to the firearm. As used herein, the verb "to comprise" in this description, claims, and other conjugations are used in its non-limiting sense to mean those items following the word are included, but items not specifically mentioned are not excluded. As used herein, the word "forward" means moving in the direction that the projectile moves during firing a firearm. As used herein, the word "proximal" means closer to the reference point, in this case, the shooter. As used herein, the word "distal" means farther to the reference point, in this case, the shooter. Reference to an element by the indefinite article "a" or "an" does not exclude the possibility that more than one of the elements are present, unless the context clearly requires that there is one and only one of the elements. The indefinite article "a" or "an" thus usually means "at least one." Additionally, the words "a" and "an" when used in the present document in concert with the words "comprising" or "containing" denote "one or more.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure. The recitation of numerical ranges by endpoints includes all numbers within that range (e.g. 1 to 5 includes 1, 1.5, 2, 2.75, 3, 3.80, 4, and 5). All dimensions given herein are by way of examples to better illustrate the present disclosure embodiments and shall not be construed to limit the dimensions of the present disclosure embodiments to the given numeric values.

Overview

The following description is provided with reference to FIG. 1~FIG. 8 regarding a firearm holster with safety features under various proposed schemes in accordance with the present disclosure for a firearm. In some implementations, the firearm may be a pistol, such as a semiautomatic pistol or an automatic pistol.

FIG. 1 illustrates a firearm rotation mount 100 in which various proposed schemes in accordance with the present disclosure may be implemented. FIG. 2~FIG. 9 illustrate examples of implementation of various proposed schemes that may be implemented in firearm rotation mount 100. The following description of various proposed schemes is provided with reference to FIG. 1~FIG. 9. It is noteworthy that, while the various proposed schemes may be individually or separately described below, in actual implementations some or all of the proposed schemes may be utilized or otherwise implemented jointly. Of course, each of the proposed schemes may be utilized or otherwise implemented individually or separately.

Figure 2:
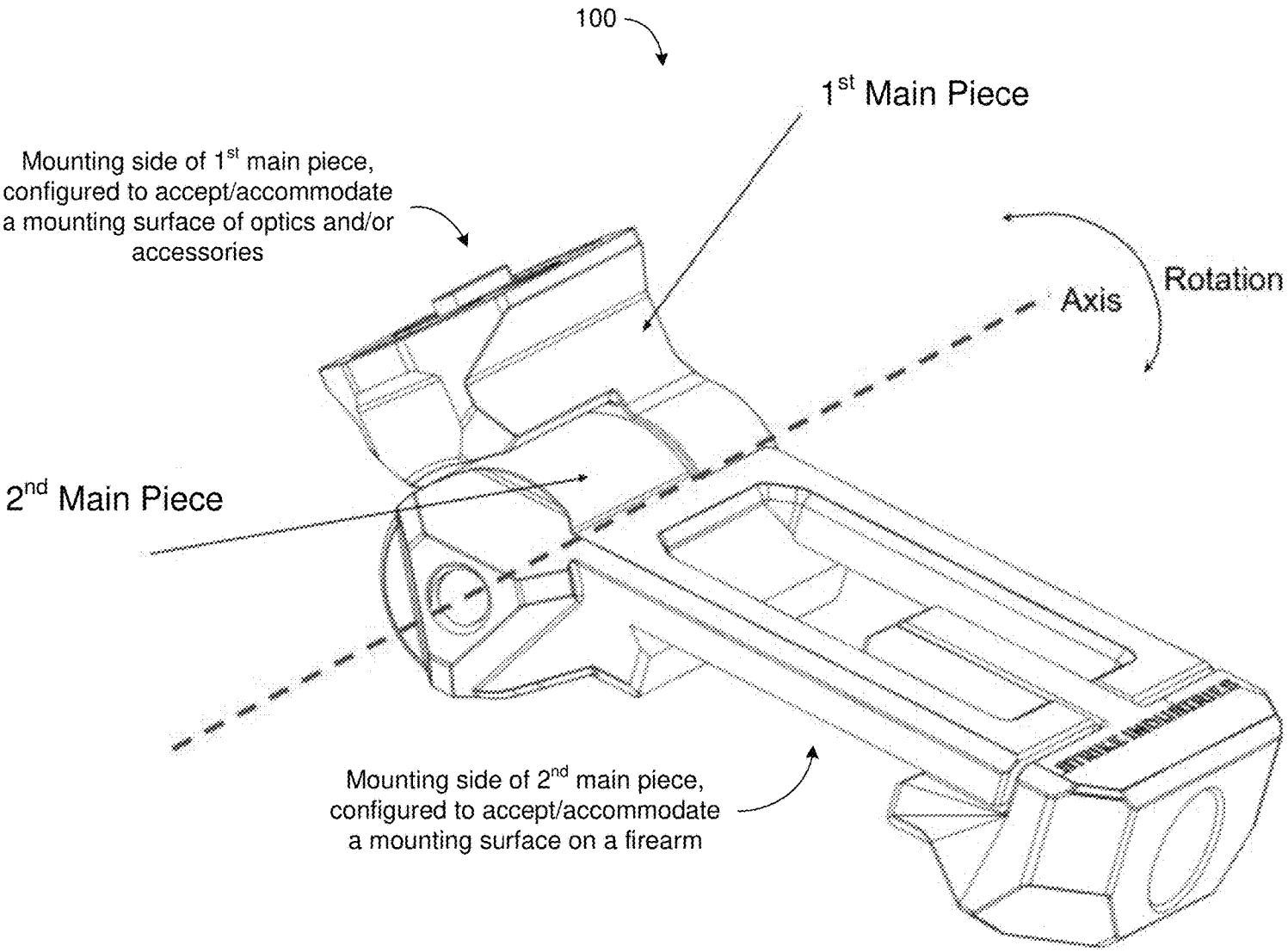
FIG. 2 is a diagram of an example implementation under a proposed scheme in accordance with the present disclosure.
Figure 3:
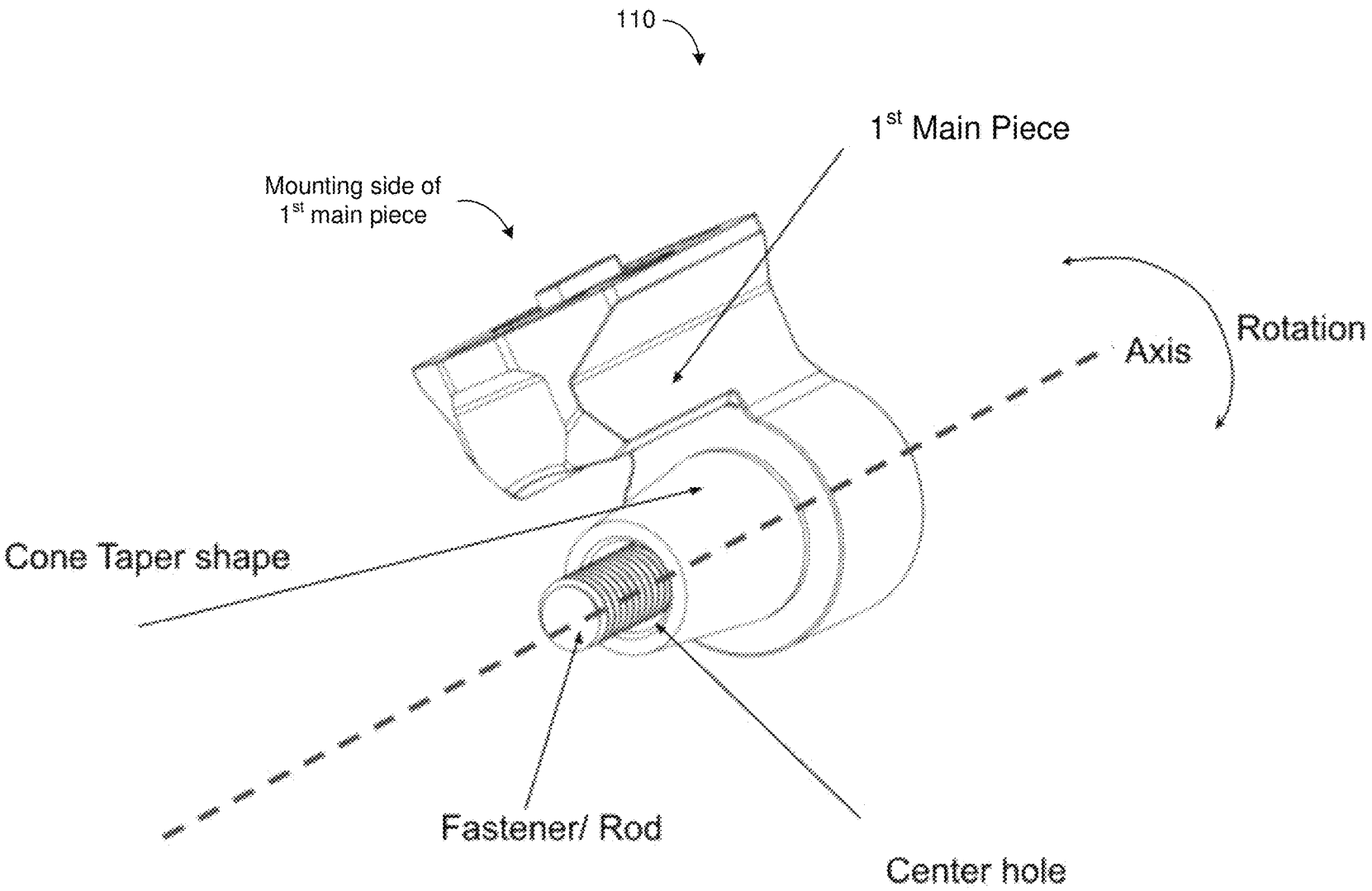
FIG. 3 is a diagram of an example implementation under a proposed scheme in accordance with the present disclosure.

Referring to FIG. 1, firearm rotation mount 100 may include certain components some of which are shown in FIG. 1 while some are not (e.g., due to being obscured by other component(s)). Those components shown in FIG. 1 include a first main piece 110, a second main piece 120, and a fastening device 130. Part (A) of FIG. 1 shows an assembly view of firearm rotation mount 100, and part (B) of FIG. 1 shows an exploded view of firearm rotation mount 100. Referring to FIG. 2 and FIG. 3, first main piece 110 may have a first mounting side that is configured to accept or otherwise accommodate a mounting surface of optics (e.g., scopes, reflex sights and/or red dot sights) and/or accessories (e.g., flashlights and/or lasers), such that the optics and/or accessories may be mounted on firearm rotation mount 100 via first main piece 110. Similarly, referring to FIG. 2 and FIG. 4, second main piece 120 may have a first mounting side that is configured to accept or otherwise accommodate a mounting surface on or of a firearm such as, for example, a Picatinny rail, 1913 rail (MIL-STD-1913 rail) or Weaver rail, such that firearm rotation mount 100 may be mounted on the firearm via second main piece 120. Each or one or more of the components of firearm rotation mount 100 may be made of metal (e.g., aluminum, steel or alloy), ceramic or polymer.

Figure 4:
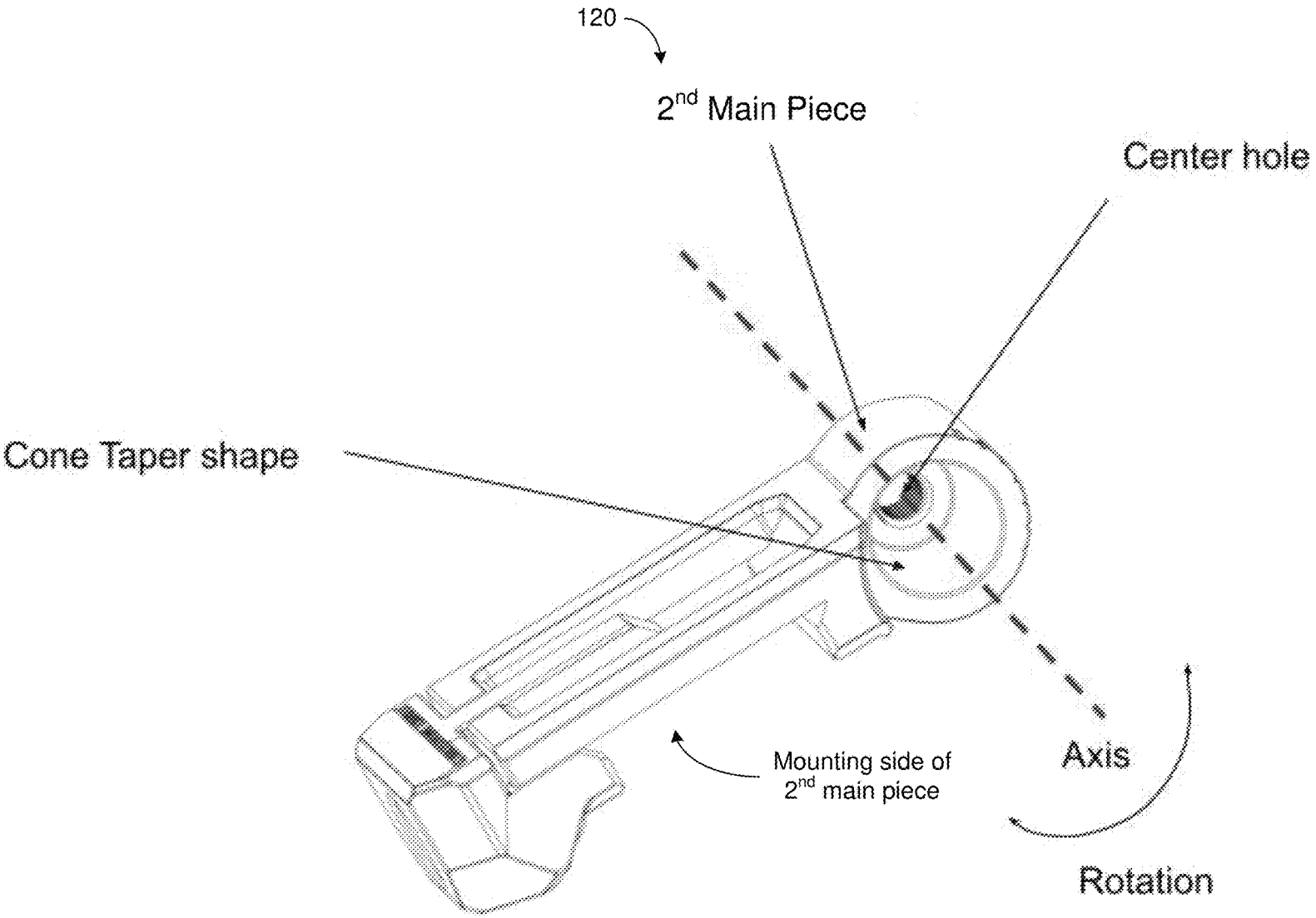
FIG. 4 is a diagram of an example implementation under a proposed scheme in accordance with the present disclosure.

Under various proposed schemes in accordance with the present disclosure, first main piece 110 and second main piece 120 may be joined or otherwise combined together to form a joint coupling, such that the rotating portion of the joint coupling (e.g., the first main piece 110, when the second main piece 120 is attached to or otherwise mounted on the firearm) may be rotated to and secured at a desired angle within a rotational range (e.g., a range of more than 90° and up to 270° or a different angle). Referring to FIG. 1, FIG. 3 and FIG. 4, first main piece 110 may be configured with a male plug with a generally cone-shaped protrusion.

Correspondingly, second main piece 120 may be configured with a female receptable with a generally cone-shaped hollow configured to mate with the male plug such that first main piece 110 may be pivotable around a rotation axis of rotation mount 100 when first main piece 110 and second main piece 120 are pivotably joined together.

Under various proposed schemes in accordance with the present disclosure, first main piece 110 may have a first through hole that traverses through first main piece 110 along the rotation axis of firearm rotation mount 100. Additionally, second main piece 120 may have a second through hole that traverses through second main piece 120 along the rotation axis of firearm rotation mount 100. Moreover, fastening device 130 may be configured to traverse through the first through hole and the second through hole when first main piece 110 and second main piece 120 are pivotably joined together.

Figure 5:
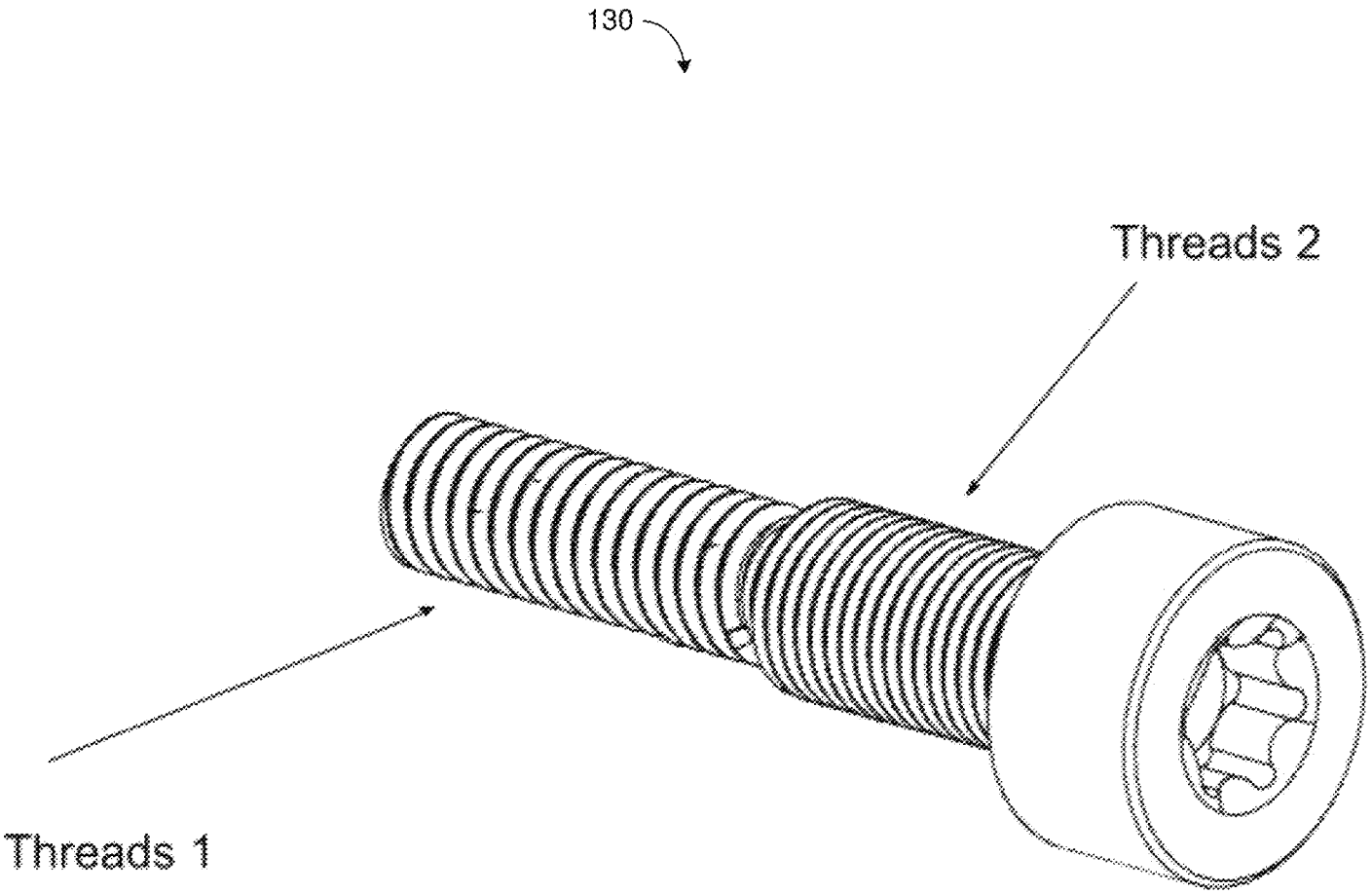
FIG. 5 is a diagram of an example implementation under a proposed scheme in accordance with the present disclosure.

Under one proposed scheme in accordance with the present disclosure (Design 1), fastening device 130 may include a fastener or rod. Referring to FIG. 5, at least a first portion of the fastener or rod that traverses through the second through hole may be threaded. Furthermore, the second through hole may be threaded correspondingly to mate with the first portion of the fastener or rod. In some implementations, a second portion of the fastener or rod that traverses through the first through hole may be threaded. Moreover, the first through hole may be threaded correspondingly to mate with the second portion of the fastener or rod. In some implementations, threads on the first portion of the fastener or rod and threads on the second portion of the fastener or rod may be of opposite rotations. In some implementations, a diameter of the first portion of the fastener or rod and a diameter of the second portion of the fastener or rod may be different.

Figure 6:
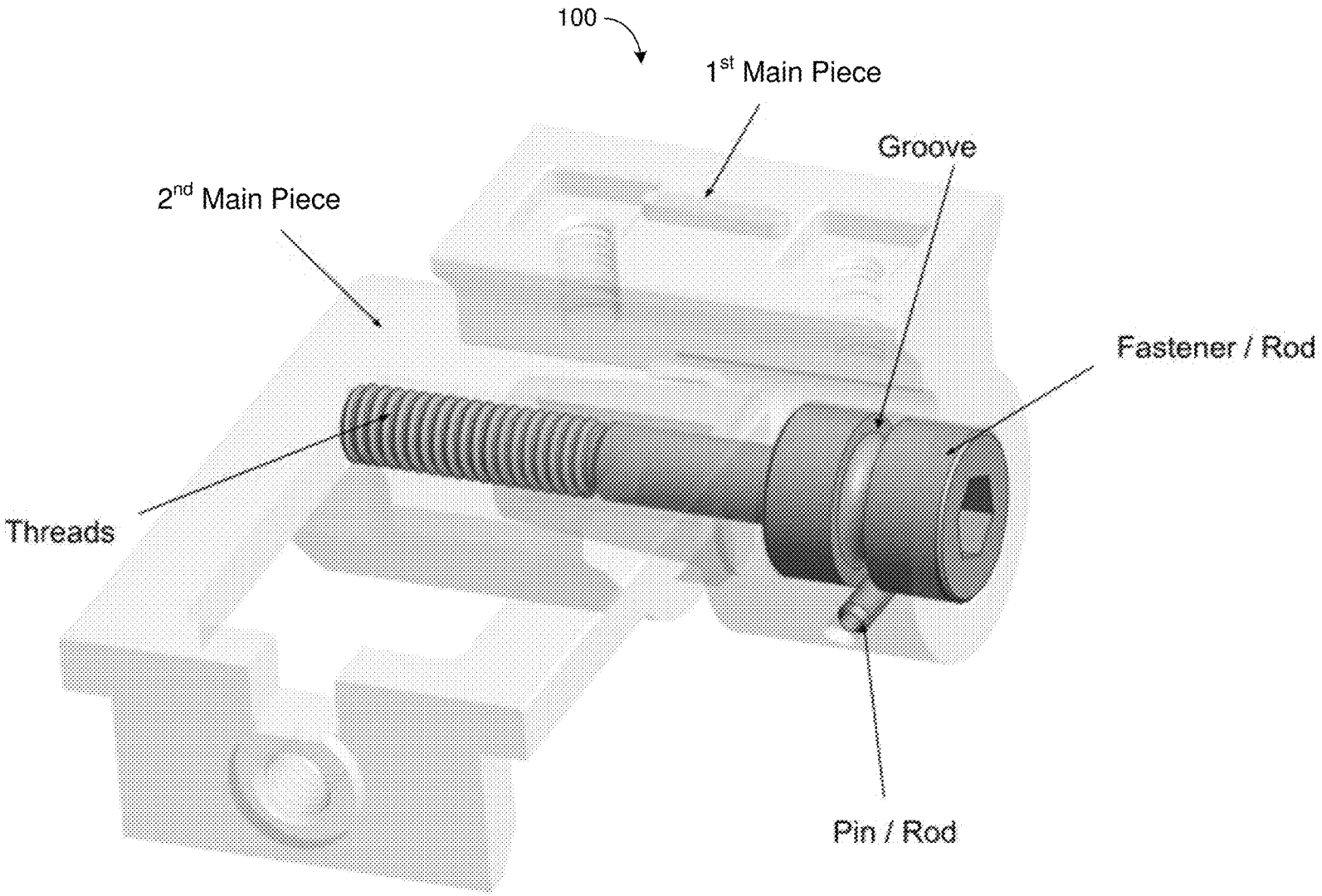
FIG. 6 is a diagram of an example implementation under a proposed scheme in accordance with the present disclosure.

Under another proposed scheme in accordance with the present disclosure (Design 2), fastening device 130 may include a fastener and a pin, as shown in FIG. 6. Additionally, the fastener may be configured with a groove around an outer circumference thereof. Furthermore, the fastener may be secured by the pin with the pin traversing through a pin hole on the first main piece. This way, the fastener may be rotated freely by the user without walking out of first main piece 110.

Figure 7:
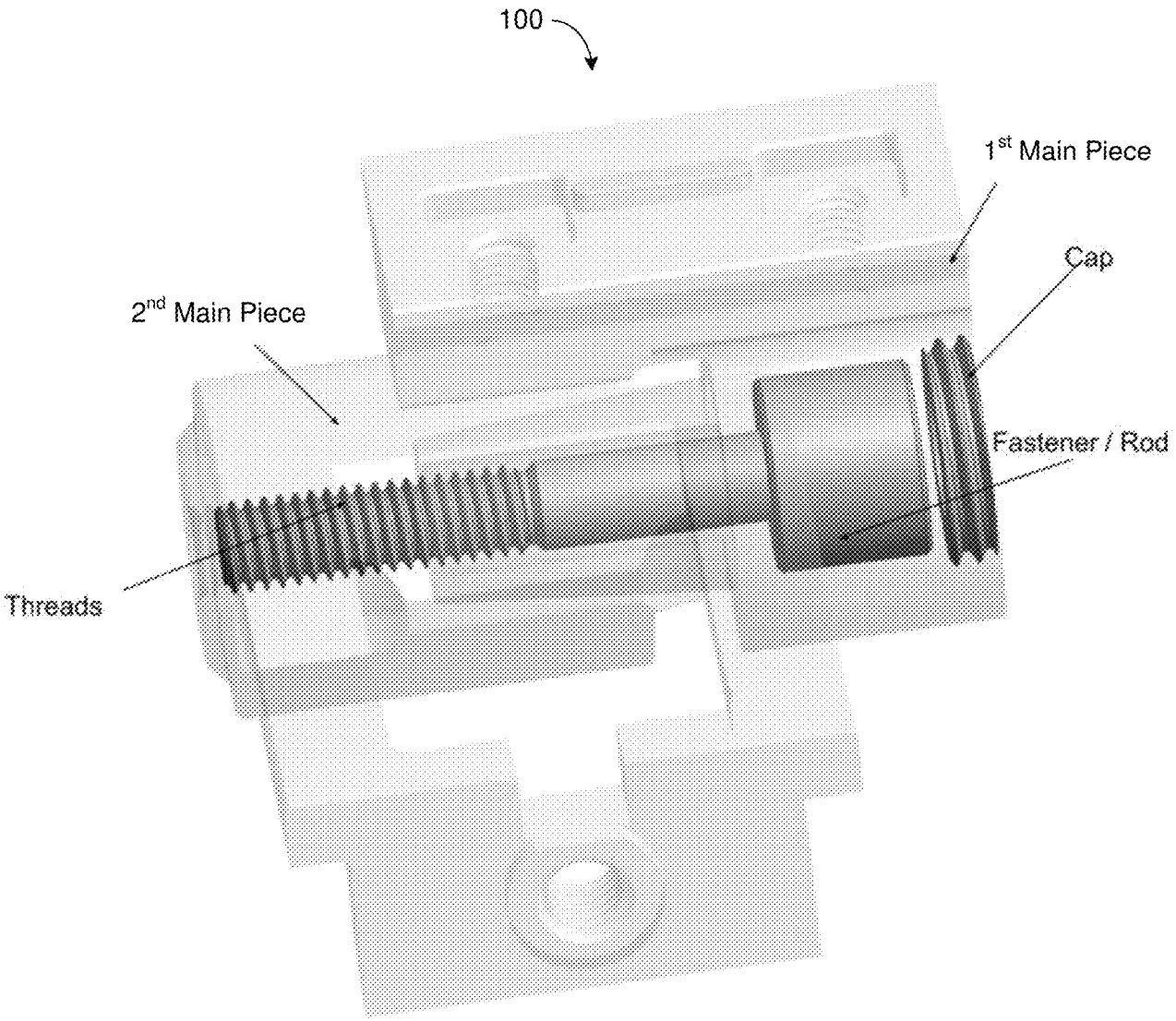
FIG. 7 is a diagram of an example implementation under a proposed scheme in accordance with the present disclosure.
Figure 8:
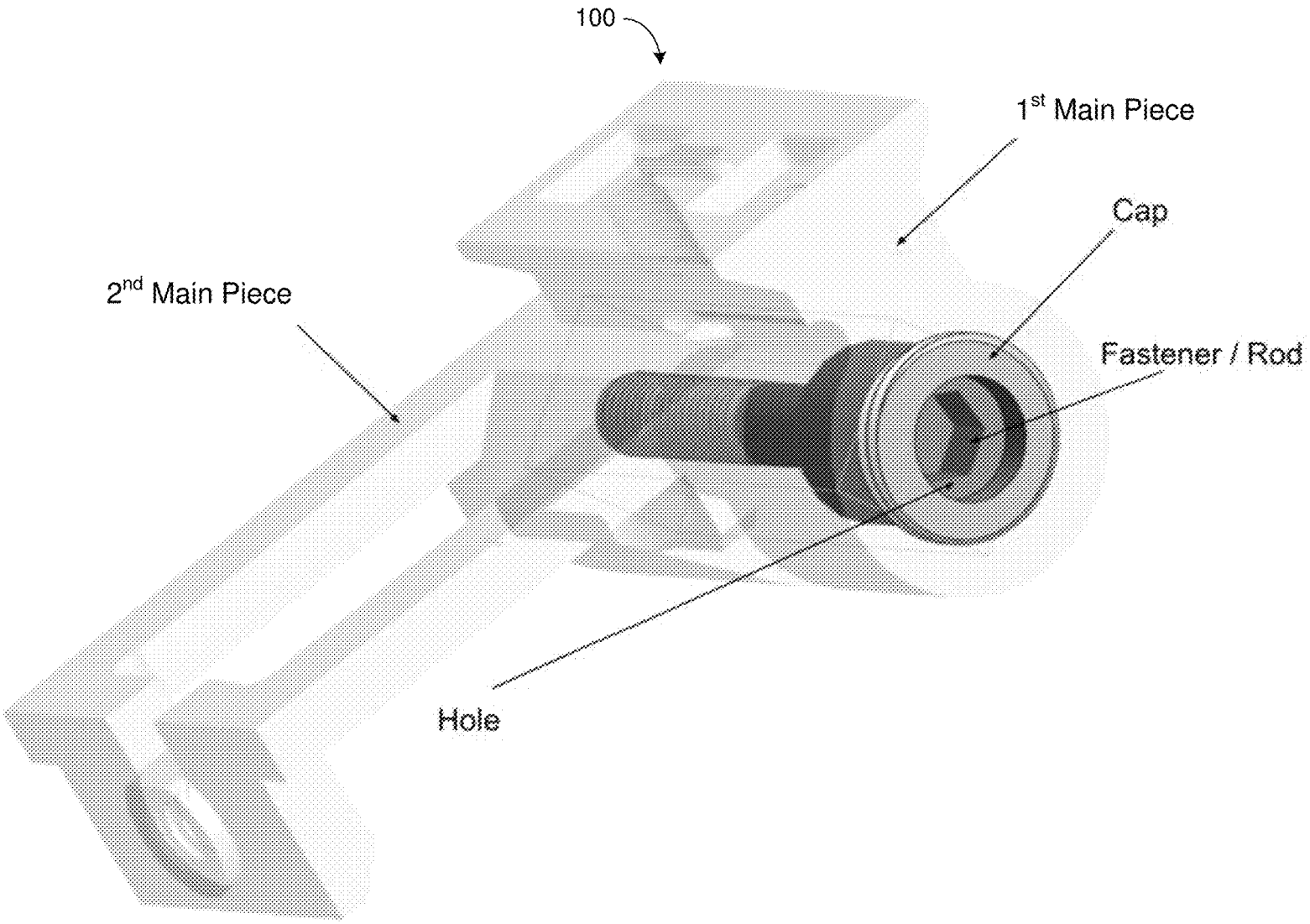
FIG. 8 is a diagram of an example implementation under a proposed scheme in accordance with the present disclosure.

Under yet another proposed scheme in accordance with the present disclosure (Design 3), fastening device 130 may include a fastener and a ring cap, as shown in FIG. 7 and FIG. 8. Accordingly, when installed, the ring cap may be received in the first through hole with the fastener traversing both the first through hole and the second through hole such that an opening of the ring cap exposes an operable end of the fastener so that fastener is operable by a user through the opening, as shown in FIG. 8. In some implementations, a diameter of the ring cap may be smaller than a diameter of the fastener such that, when the fastener is rotated, a linear movement by the fastener in a direction along the rotation axis is prevented by the ring cap. This way, the fastener may be rotated freely by the user without walking out of first main piece 110. In some implementations, an outer circumference of the ring cap may be threaded.

Figure 9:
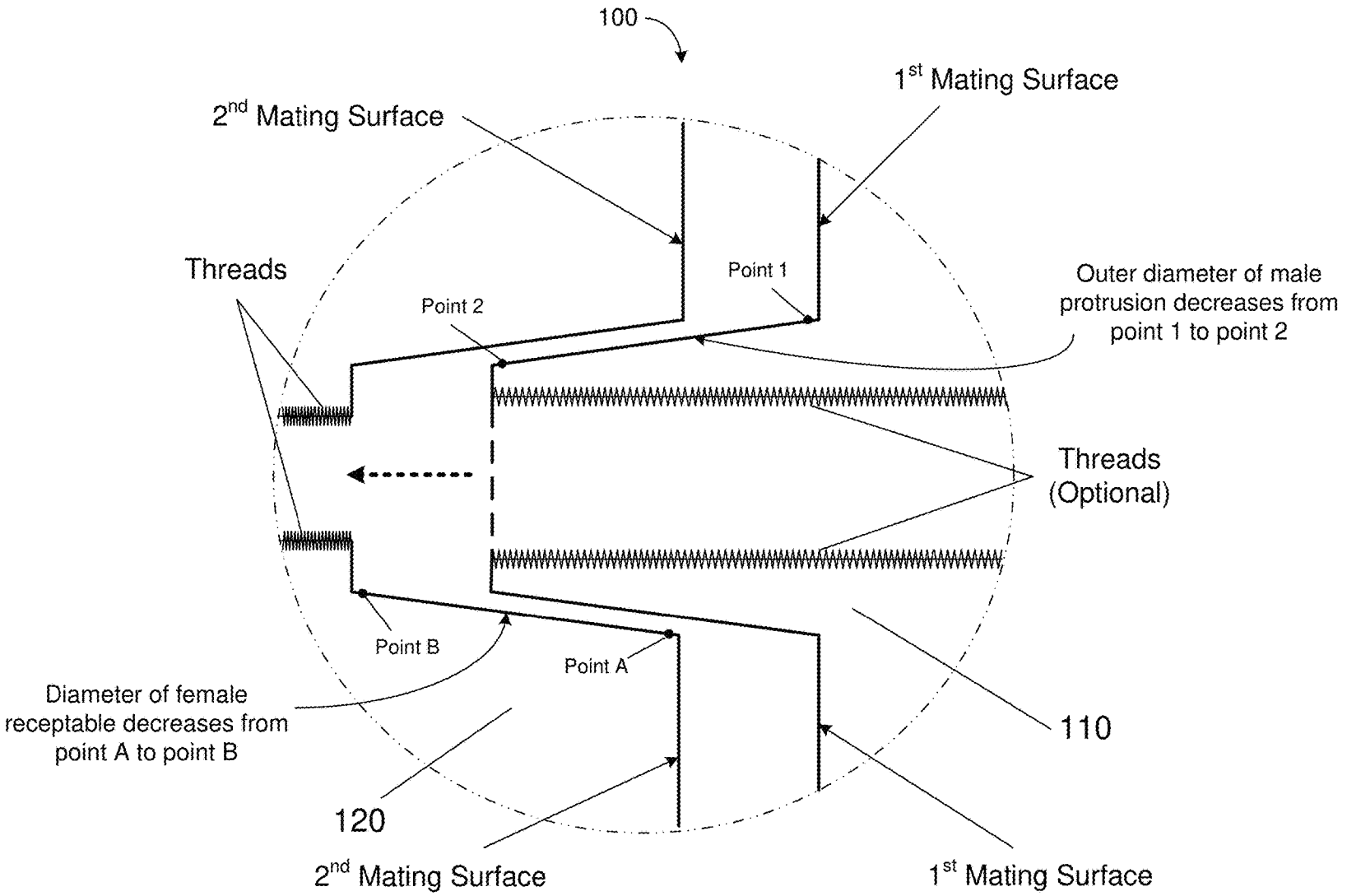
FIG. 9 is a diagram of an example implementation under a proposed scheme in accordance with the present disclosure.

Referring to FIG. 9, a diameter of the generally cone-shaped hollow of the female receptable may decrease linearly from a first point (denoted as "Point A" in FIG. 9) near a second mating surface (which is on the second main piece that contacts a first mating surface on the first main piece when the first main piece and the second main piece are joined together) to a second point (denoted as "Point B" in FIG. 9) further away from the second mating surface. Although not shown in the figures, alternatively, the diameter of the generally cone-shaped hollow of the female receptable may decrease non-linearly or parabolically from the first point (Point A) to the second point (Point B).

Similarly, referring to FIG. 9, an outer diameter of the generally cone-shaped protrusion of the male plug may decrease linearly from a first point (denoted as "Point 1" in FIG. 9) near a first mating surface (which is on the first main piece that contacts a second mating surface on the second main piece when the first main piece and the second main piece are joined together) to a second point (denoted as "Point 2" in FIG. 9) further away from the first mating surface. Although not shown in the figures, alternatively, the outer diameter of the generally cone-shaped protrusion of the male plug may decrease non-linearly or parabolically from the first point (Point 1) to the second point (Point 2).

It is believed that one of ordinary skill in the art would appreciate the benefits provided by the various schemes proposed herein. Specifically, under the proposed schemes, once the fastening device 130 is tightened, first main piece 110 and second main piece 120 may be secured in place. To rotate first main piece 110 (and the accessory attached to first main piece 110) to a different angle or orientation, a user would simply unscrew or otherwise loosen fastening device 130 to a certain extent such that first main piece 110 is pivotable or otherwise rotatable relative to second main piece 120. Such designs provide stability and prevent any wobbling or any unintended movement of components of firearm rotation mount 100.

It is noteworthy that, although in the examples shown in FIG. 1~FIG. 9 first main piece 110 is shown to be configured with a male plug with a generally cone-shaped protrusion while second main piece 120 is shown to be configured with a female receptable with a generally cone-shaped hollow, in alternative implementations, second main piece 120 may be configured with a male plug with a generally cone-shaped protrusion while first main piece 110 may to be configured with a female receptable with a generally cone-shaped hollow. That is, either of first main piece 110 and second main piece 120 may be a male coupling portion while the other may correspondingly be a female coupling portion.

Highlight of Select Features

In view of the above, select features of various implementations in accordance with the present disclosure are highlighted below.

In one aspect, a device implementable on a firearm may include a rotation mount comprising a first main piece and a second main piece. The first main piece may have a first mounting side configured to accommodate mounting of optics and accessories thereon. The second main piece may have a second mounting side configured to accommodate a mounting surface on the firearm such that the rotation mount is installable on the firearm via the second main piece. The first main piece may be configured with a first coupling portion with a generally cone-shaped first feature. The second main piece may be configured with a second coupling portion with a generally cone-shaped second feature configured to mate with the first feature of the first coupling portion such that the first main piece is pivotable around a rotation axis of the rotation mount when the first main piece and the second main piece are pivotably joined together.

In some implementations, either the first coupling portion or the second coupling portion may include a female receptable. Moreover, either the first feature or the second feature may include a generally cone-shaped hollow. Furthermore, a diameter of the generally cone-shaped hollow of the female receptable may decrease linearly from a first point (e.g., Point A in FIG. 9) near a second mating surface on the second main piece that contacts a first mating surface on the first main piece when the first main piece and the second main piece are joined together to a second point (e.g., Point B in FIG. 9) further away from the second mating surface.

Alternatively, either the first coupling portion or the second coupling portion may include a female receptable. Moreover, either the first feature or the second feature may include a generally cone-shaped hollow. Furthermore, a diameter of the generally cone-shaped hollow of the female receptable may decrease non-linearly or parabolically from a first point (e.g., Point A in FIG. 9) near a second mating surface on the second main piece that contacts a first mating surface on the first main piece when the first main piece and the second main piece are joined together to a second point (e.g., Point B in FIG. 9) further away from the second mating surface.

In some implementations, either the first coupling portion or the second coupling portion may include a male plug. Additionally, either the first feature or the second feature may include a generally cone-shaped hollow. Furthermore, an outer diameter of the generally cone-shaped protrusion of the male plug may decrease linearly from a first point (e.g., Point 1 in FIG. 9) near a first mating surface on the first main piece that contacts a second mating surface on the second main piece when the first main piece and the second main piece are joined together to a second point (e.g., Point 2 in FIG. 9) further away from the first mating surface.

In some implementations, either the first coupling portion or the second coupling portion may include a male plug. Additionally, either the first feature or the second feature may include a generally cone-shaped hollow. Furthermore, an outer diameter of the generally cone-shaped protrusion of the male plug may decrease non-linearly or parabolically from a first point (e.g., Point 1 in FIG. 9) near a first mating surface on the first main piece that contacts a second mating surface on the second main piece when the first main piece and the second main piece are joined together to a second point (e.g., Point 2 in FIG. 9) further away from the first mating surface.

In some implementations, the device may also include a fastening device. Accordingly, the first main piece may have a first through hole traversing through the first main piece along the rotation axis of the rotation mount. Additionally, the second main piece may have a second through hole traversing through the second main piece along the rotation axis of the rotation mount. Moreover, the fastening device may be configured to traverse through the first through hole and the second through hole when the first main piece and the second main piece are pivotably joined together.

In some implementations, the fastening device may include a fastener or rod. Moreover, at least a first portion of the fastener or rod that traverses through the second through hole may be threaded. Furthermore, the second through hole may be threaded correspondingly to mate with the first portion of the fastener or rod.

In some implementations, a second portion of the fastener or rod that traverses through the first through hole may be threaded. Moreover, the first through hole may be threaded correspondingly to mate with the second portion of the fastener or rod. In some implementations, threads on the first portion of the fastener or rod and threads on the second portion of the fastener or rod may be of opposite rotations. In some implementations, a diameter of the first portion of the fastener or rod and a diameter of the second portion of the fastener or rod may be different.

In some implementations, the fastening device may include a fastener and a pin. Additionally, the fastener may be configured with a groove around an outer circumference thereof. Furthermore, the fastener may be secured by the pin with the pin traversing through a pin hole on the first main piece.

In some implementations, the fastening device may include a fastener and a ring cap. Accordingly, when installed, the ring cap may be received in the first through hole with the fastener traversing both the first through hole and the second through hole such that an opening of the ring cap exposes an operable end of the fastener so that fastener is operable by a user through the opening. In some implementations, a diameter of the ring cap may be smaller than a diameter of the fastener such that, when the fastener is rotated, a linear movement by the fastener in a direction along the rotation axis is prevented by the ring cap. In some implementations, an outer circumference of the ring cap may be threaded.

In another aspect, a device implementable on a firearm may include a rotation mount comprising a first main piece and a second main piece. The first main piece may be configured with a first coupling portion with a first feature. The second main piece may be configured with a second coupling portion with a second feature configured to mate with the first feature of the first coupling portion such that the first main piece is pivotable around a rotation axis of the rotation mount when the first main piece and the second main piece are pivotably joined together. One of the first coupling portion and the second coupling portion may include a male plug while the other of the first coupling portion and the second coupling portion may include a female receptable. Additionally, one of the first feature or the second feature may include a generally cone-shaped protrusion of the male plug while the other of the first feature or the second feature may include a generally cone-shaped hollow of the female receptable. Moreover, an outer diameter of the protrusion of the male plug may decrease from a first point (e.g., Point 1 in FIG. 9) near a first mating surface on the first main piece that contacts a second mating surface on the second main piece when the first main piece and the second main piece are joined together to a second point (e.g., Point 2 in FIG. 9) further away from the first mating surface. Correspondingly, a diameter of the hollow of the female receptable may decrease from a third point (e.g., Point A in FIG. 9) near the second mating surface to a fourth point (e.g., Point B in FIG. 9) further away from the second mating surface.

In some implementations, the device may further include a fastening device. Accordingly, the first main piece may have a first through hole traversing through the first main piece along the rotation axis of the rotation mount. Additionally, the second main piece may have a second through hole traversing through the second main piece along the rotation axis of the rotation mount. Moreover, the fastening device may be configured to traverse through the first through hole and the second through hole when the first main piece and the second main piece are pivotably joined together.

In some implementations, the fastening device may include a fastener or rod. Additionally, at least a first portion of the fastener or rod that traverses through the second through hole may be threaded. Moreover, the second through hole may be threaded correspondingly to mate with the first portion of the fastener or rod, wherein a second portion of the fastener or rod that traverses through the first through hole is threaded. Furthermore, the first through hole may be threaded correspondingly to mate with the second portion of the fastener or rod.

In some implementations, a second portion of the fastener or rod that traverses through the first through hole may be threaded. Moreover, the first through hole may be threaded correspondingly to mate with the second portion of the fastener or rod. Furthermore, threads on the first portion of the fastener or rod and threads on the second portion of the fastener or rod may be of opposite rotations.

In some implementations, the fastening device may include a fastener and a pin. Moreover, the fastener may be configured with a groove around an outer circumference thereof. Additionally, the fastener may be secured by the pin with the pin traversing through a pin hole on the first main piece.

In some implementations, the fastening device may include a fastener and a ring cap. Accordingly, when installed, the ring cap may be received in the first through hole with the fastener traversing both the first through hole and the second through hole such that an opening of the ring cap exposes an operable end of the fastener so that fastener is operable by a user through the opening. Moreover, a diameter of the ring cap may be smaller than a diameter of the fastener such that, when the fastener is rotated, a linear movement by the fastener in a direction along the rotation axis is prevented by the ring cap.

ADDITIONAL NOTES

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. A device implementable on a firearm, comprising:

a rotation mount comprising a first main piece and a second main piece; and a fastening device, wherein:

the first main piece has a first mounting side configured to accommodate mounting of optics and accessories thereon, the second main piece has a second mounting side configured to accommodate a mounting surface on the firearm such that the rotation mount is installable on the firearm via the second main piece, the first main piece is configured with a first coupling portion with a generally cone-shaped first feature, the second main piece is configured with a second coupling portion with a generally cone-shaped second feature configured to mate with the first feature of the first coupling portion such that the first main piece is pivotable around a rotation axis of the rotation mount when the first main piece and the second main piece are pivotably joined together, the first main piece has a first through hole traversing through the first main piece along the rotation axis of the rotation mount, the second main piece has a second through hole traversing through the second main piece along the rotation axis of the rotation mount, and the fastening device is configured to traverse through the first through hole and the second through hole when the first main piece and the second main piece are pivotably joined together, the fastening device comprises a fastener and a ring cap, and when installed, the ring cap is received in the first through hole with the fastener traversing both the first through hole and the second through hole such that an opening of the ring cap exposes an operable end of the fastener so that the fastener is operable by a user through the opening.

2. The device of claim 1, wherein either the first coupling portion or the second coupling portion comprises a female receptable, wherein either the first feature or the second feature comprises a generally cone-shaped hollow, wherein a diameter of the generally cone-shaped hollow of the female receptable decreases linearly from a first point near a second mating surface on the second main piece that contacts a first mating surface on the first main piece when the first main piece and the second main piece are joined together to a second point further away from the second mating surface than the first point.

3. The device of claim 1, wherein either the first coupling portion or the second coupling portion comprises a female receptable, wherein either the first feature or the second feature comprises a generally cone-shaped hollow, wherein a diameter of the generally cone-shaped hollow of the female receptable decreases non-linearly or parabolically from a first point near a second mating surface on the second main piece that contacts a first mating surface on the first main piece when the first main piece and the second main piece are joined together to a second point further away from the second mating surface than the first point.

4. The device of claim 1, wherein either the first coupling portion or the second coupling portion comprises a male plug, wherein either the first feature or the second feature comprises a generally cone-shaped protrusion, wherein an outer diameter of the generally cone-shaped protrusion of the male plug decreases linearly from a first point near a first mating surface on the first main piece that contacts a second mating surface on the second main piece when the first main piece and the second main piece are joined together to a second point further away from the first mating surface than the first point.

5. The device of claim 1, wherein either the first coupling portion or the second coupling portion comprises a male plug, wherein either the first feature or the second feature comprises a generally cone-shaped protrusion, wherein an outer diameter of the generally cone-shaped protrusion of the male plug decreases non-linearly or parabolically from a first point near a first mating surface on the first main piece that contacts a second mating surface on the second main piece when the first main piece and the second main piece are joined together to a second point further away from the first mating surface than the first point.

6. The device of claim 1, wherein a diameter of the ring cap is smaller than a diameter of the fastener such that, when the fastener is rotated, a linear movement by the fastener in a direction along the rotation axis is prevented by the ring cap.

7. The device of claim 1, wherein an outer circumference of the ring cap is threaded.

8. A device implementable on a firearm, comprising:

a rotation mount comprising a first main piece and a second main piece; and a fastening device, wherein:

the first main piece is configured with a first coupling portion with a first feature, the second main piece is configured with a second coupling portion with a second feature configured to mate with the first feature of the first coupling portion such that the first main piece is pivotable around a rotation axis of the rotation mount when the first main piece and the second main piece are pivotably joined together, one of the first coupling portion and the second coupling portion comprises a male plug while the other of the first coupling portion and the second coupling portion comprises a female receptable, one of the first feature and the second feature comprises a generally cone-shaped protrusion of the male plug while the other of the first feature and the second feature comprises a generally cone-shaped hollow of the female receptable, an outer diameter of the protrusion of the male plug decreases from a first point near a first mating surface on the first main piece that contacts a second mating surface on the second main piece when the first main piece and the second main piece are joined together to a second point further away from the first mating surface than the first point, a diameter of the hollow of the female receptable decreases from a third point near the second mating surface to a fourth point further away from the second mating surface than the third point, the first main piece has a first through hole traversing through the first main piece along the rotation axis of the rotation mount, the second main piece has a second through hole traversing through the second main piece along the rotation axis of the rotation mount, the fastening device is configured to traverse through the first through hole and the second through hole when the first main piece and the second main piece are pivotably joined together, the fastening device comprises a fastener and a ring cap, when installed, the ring cap is received in the first through hole with the fastener traversing both the first through hole and the second through hole such that an opening of the ring cap exposes an operable end of the fastener so that the fastener is operable by a user through the opening, and a diameter of the ring cap is smaller than a diameter of the fastener such that, when the fastener is rotated, a linear movement by the fastener in a direction along the rotation axis is prevented by the ring cap.

* * * * *